US006841265B2

(12) United States Patent
Kurisu et al.

(10) Patent No.: US 6,841,265 B2
(45) Date of Patent: Jan. 11, 2005

(54) TITANIUM ALLOY VACUUM AND VACUUM PART

(75) Inventors: Hiroki Kurisu, Ube (JP); Mitsuru Matsuura, Ube (JP); Setsuo Yamamoto, Ube (JP); Masaki Hesaka, Ube (JP); Atsushi Takemura, Tokyo (JP)

(73) Assignees: Yamaguchi Technology Licensing Organization, Ltd., Yamaguchi (JP); Shinko Industries Co., Ltd., Yamaguchi (JP)

( * ) Notice: Subject to any disclaimer, the term of this patent is extended or adjusted under 35 U.S.C. 154(b) by 193 days.

(21) Appl. No.: 10/312,701

(22) PCT Filed: Mar. 18, 2002

(86) PCT No.: PCT/JP02/02566

§ 371 (c)(1),
(2), (4) Date: Dec. 30, 2002

(87) PCT Pub. No.: WO02/083286

PCT Pub. Date: Oct. 24, 2002

(65) Prior Publication Data

US 2003/0162042 A1 Aug. 28, 2003

(30) Foreign Application Priority Data

Mar. 26, 2001 (JP) ..... 2001-88100

(51) Int. Cl.[7] ..... B23P 15/00
(52) U.S. Cl. ..... 428/687; 428/472.1; 428/923
(58) Field of Search ..... 428/687, 472.1, 428/923

(56) References Cited

FOREIGN PATENT DOCUMENTS

| | | |
|---|---|---|
| JP | 249674 A | 9/1992 |
| JP | 4-249674 A | 9/1992 |
| JP | 064600 | 3/1994 |
| JP | 065661 | 3/1994 |
| JP | 053163 | 2/1997 |
| JP | 9-53163 A | 2/1997 |
| JP | 017961 | 1/1998 |
| JP | 017962 | 1/1998 |
| JP | 265935 | 10/1998 |
| JP | 10-265935 A | 10/1998 |
| JP | 3030458 | 4/2000 |

OTHER PUBLICATIONS

T. Chijimatsu et al., *J. Vac. Soc. Jpn.*, vol. 42, No.3, (1999), pp. 200–203, month not provided.
Y. Itoh et al., *J. Vac. Soc. Jpn.*, vol. 40, No. 3, (1997), pp. 248–250, month not provided.

*Primary Examiner*—Robert R. Koehler
(74) *Attorney, Agent, or Firm*—Birch, Stewart, Kolasch & Birch, LLP

(57) ABSTRACT

The objective of the present invention is to provide a titanium alloy vacuum container and vacuum parts that can easily achieve an ultra-high vacuum in a short time through vacuum evacuation.

The titanium alloy of the titanium alloy vacuum container and vacuum parts has a compact structure composed of fine grains, each having a size of approximately not more than 10 μm, with a surface that is exposed to at least vacuum being set to have a surface roughness of not more than 50 nm; and in this structure, preferably, the surface roughness thereof may be set to not more than 10 nm, the titanium alloy may have a hardness in a range of not less than 230 Hv to not more than 310 Hv, and the titanium alloy may have a passivity surface film made by a thin titanium oxide layer or nitride layer that is formed on the surface thereof. The titanium alloy, which is desirably used in such titanium alloy vacuum container and vacuum parts, contains 0.3 wt. % to 0.5 wt. % of iron and 0.3 wt. % to 0.5 wt. % of oxygen, and the remainder thereof is made from Ti obligatory impurities.

13 Claims, 4 Drawing Sheets

(a) Front View (b) Top View

Pressure evacuation curve after baking at 160°C for 48 hours

Pressure evacuation curve without baking

TITANIUM ALLOY VACUUM AND VACUUM PART

This application is the national phase under 35 U.S.C. § 371 of PCT International Application No. PCT/JP02/02566 which has an International filing date of Mar. 18, 2002, which designated the United States of America.

FIELD OF THE INVENTION

The present invention relates to a titanium alloy vacuum container and vacuum parts, which can easily achieve an ultra-high vacuum in a short time through evacuation.

BACKGROUND OF THE INVENTION

At present, vacuum devices have been widely used in various industries, including devices for manufacturing various electronic elements in the semiconductor industry, and have become indispensable for the leading scientific technological fields such as high energy physics and solid surface science. For example, with respect to the vacuum devices used for manufacturing semiconductor electronic parts and LSIs, an ultra-high vacuum in a range from $10^{-5}$ Pa to $10^{-7}$ Pa has been required, and with respect to the ultra-high vacuum film-forming devices used for forming high-quality semiconductor thin-films and ultra-structural films, a pressure in range of not more than $10^{-8}$ Pa is required. Moreover, in the next generation high-degree information communication society, there are demands for developing single-electron devices and new electron-optical devices which provide high-speed information communication devices and large-capacity information recording processes, and in order to create these new devices, it is required to control a layer-laminating process in the order of one atom layer under a very clean ultra- to extremely-high vacuum. In other words, in the devices for manufacturing these new devices, there have been strong demands for developing vacuum devices which easily achieve a pressure in a range of not more than $10^{-8}$ Pa.

Conventionally, ultra-high vacuum containers and ultra-high vacuum parts are generally made of stainless steel and aluminum alloy, and in such generally-used vacuum devices, in order to achieve an ultra-high vacuum range of not more than $10^{-5}$ Pa, an initial evacuation process is carried out for 5 to 8 hours after activation of an evacuation device, and it is necessary to successively carry out a process referred to as a vacuum baking process (vacuum baking) for approximately 5 to several tens of hours. Moreover, in the case of devices which require an ultra- to extremely-high vacuum of not more than $10^{-8}$ Pa, for example, vacuum film-forming devices for laminating multiple layers of semiconductors having a film thickness of, for example, several nanometers, it is necessary to combine a plurality of ultra-high vacuum pumps, such as sputter ion pumps and titanium sublimation pumps, and it is also necessary to provide shroud (coolant reservoir) that has been cooled by liquid nitrogen in the device.

Moreover, in general, since stainless steel and aluminum alloy release a large quantity of gases, it is difficult to obtain a pressure of not more than $10^{-8}$ Pa by using only an evacuation process, and at present, it is possible to somehow achieve an ultra- to extremely-high vacuum of not more than $10^{-8}$ Pa by using specially-cleaned steel in which impurities are reduced in the steel and further finishing the surface thereof to a mirror surface through a polishing process.

As described above, in the conventional generally-used ultra-high vacuum device, an evacuation device using a plurality of ultra-high vacuum pumps combined with one another is required, and in the ultra-high vacuum containers and ultra-high vacuum parts, special steel in which impurities have been reduced is required, and mirror-surface finishing needs to be carried out on the surface thereof, resulting in high costs of the device. Moreover, in order to maintain an ultra-high vacuum, it is necessary to continuously drive the vacuum device, resulting in high driving costs. Furthermore, since it takes a long time to achieve a predetermined ultra-high vacuum, the resulting problem is a reduction in the rate of operation.

In order to solve these problems with vacuum devices, studies and developments, which attempt to practically utilize titanium or titanium alloys that have been seldom used for vacuum devices conventionally because of high costs thereof in comparison with stainless steel and the like so as to easily achieve an ultra- to extremely-high vacuum of not more than $10^{-8}$ Pa, have been carried out energetically.

In other words, although expensive in comparison with stainless steel and the like, titanium or titanium alloys have comparatively high strength and light weight, and are superior in corrosion resistance, and since these are produced through a high-vacuum refining process, the quantity of gas mixture into the metallographic structure during the refining process is extremely small, and the resulting material is preferably used as ultra-high vacuum containers, etc.; thus, for example, in accordance with studies made by the inventors, etc. of the present application (T. Chijimatsu, et. al., J. Vac. Soc. Jpn. Vol 42, No. 3, pp200–203 (1999)), it has been clarified that in comparison with stainless steel, titanium has a very small quantity of outgassing, that is, approximately 1/10.

With respect to the technique for applying titanium to the vacuum device, for example, a vacuum device (U.S. Pat. No. 3,030,458) in which metal (preferably titanium) that has been subjected to a high-vacuum refining process, and also has been subjected to a buff polishing process, an electrolytic polishing process and the like so as to have a surface roughness of not more than 100 nm, has been disclosed.

However, titanium has a disadvantage in that it is difficult to carry out a surface smoothing process. In other words, in accordance with the studies by the present inventors, etc., disclosed in the above-mentioned document, the surface roughness of titanium that has been subjected to generally-used buff polishing and electrolytic polishing is approximately 15 nm that is approximately 4 times greater than that of stainless steel that has been subjected to the same polishing processes; therefore, it is difficult to carry out a surface smoothing process to form the vacuum material surface into a mirror surface that is required for supplying an ultra-high vacuum container having a small quantity of outgassing that can achieve an ultra- to extremely-high vacuum of not more than $10^{-8}$ Pa in a short time.

Moreover, a metal gasket flange made of titanium, which is used for sealing vacuum, has a problem in that, when a metal gasket made of oxygen free copper, which is normally used in many cases, is applied, vacuum leakage tends to occur even in applications of approximately 10 times.

With respect to titanium alloys, since industrial titanium alloys generally have high strength, and have problems with the mechanical machining properties or surface processability that are required for a material for vacuum devices, material developments have been carried out so as to be applied to vacuum devices, and, for example, an ultra-high vacuum titanium alloy (Japanese Patent Laid-Open Publication No. H06(1994)-065661), which has a small quantity of gas discharge, and contains a platinum based metal, a transition metal, a rear-earth element and the like, and an ultra-high vacuum container (Japanese Patent Laid-Open Publication No. H06(1994)-064600) using such a titanium alloy have been disclosed, and it has been shown that the quantity of outgassing is set to not more than 1/10 of that of stainless steel. However, these conventional techniques have disclosed nothing about the surface proccessability, etc. of the material that are required for providing an ultra-high vacuum container capable of providing an ultra- to extremely-high vacuum in a short time, which is the objective of the present invention. Moreover, since comparatively expensive alloy elements are used in these conventional techniques, the resulting devices cause high costs.

Here, with respect to titanium alloys, in addition to the application for vacuum devices, various material developments have been carried out, and, for example, a technique (Japanese Patent Laid-Open Publication No. H10(1998)-017962), which uses iron and oxygen as alloy elements so as to provide a high strength titanium alloy that is superior in the decorative property, toughness, processing property, organism compatibility and cost performance, and is particularly useful as a material for accessories, has been disclosed, and a technique (Japanese Patent Laid-Open Publication No. H10(1998)-017961), which uses iron, oxygen and silicon as alloy elements, has been disclosed to indicate applicability to a wide range of products such as sports products in addition to the application as accessories. However, these conventional techniques have not disclosed anything clearly about the applicability as a material for vacuum devices, such as a outgassing property and a surface processability.

The present invention has been devised to solve the above-mentioned problems with the vacuum device, and its object is to provide a titanium alloy vacuum container and vacuum parts which can achieve an ultra-high vacuum in a short time through evacuation.

DISCLOSURE OF THE INVENTION

In order to achieve the above-mentioned objective, a titanium alloy vacuum container and vacuum parts of the present invention, which are a vacuum container and vacuum parts whose main portions are made of a titanium alloy, and the titanium alloy has a compact structure composed of fine grains, each having a size of approximately not more than 10 $\mu$m, and in the titanium alloy vacuum container and the vacuum parts, a surface that is exposed to at least vacuum is set to have a surface roughness of not more than 50 nm. Here, the surface roughness refers to center line average roughness (Ra) measured by an atomic force microscope in a range of 10×10 $\mu$m.

More preferably, in the titanium alloy vacuum container and vacuum parts, the surface roughness of the above-mentioned titanium alloy is set to not more than 10 nm.

The above-mentioned titanium is preferably set to not less than 230 Hv in the Vickers hardness and also not more than 310 Hv in the hardness.

Moreover, the above-mentioned titanium alloy may have a passivity surface film made by a thin titanium oxide layer or nitride layer that is formed on at least the surface exposed to vacuum, and the film thickness of such a passivity surface film is preferably set to not more than 10 nm.

The titanium alloy to be used in the titanium alloy vacuum container and the vacuum parts of the present invention preferably contains 0.3 wt. % to 0.5 wt % of iron (Fe) and 0.3 wt % to 0.5 wt % of oxygen (O), and the remainder is made from titanium (Ti) and obligatory impurities.

BEST MODES FOR CARRYING OUT THE INVENTION

Figure 1:
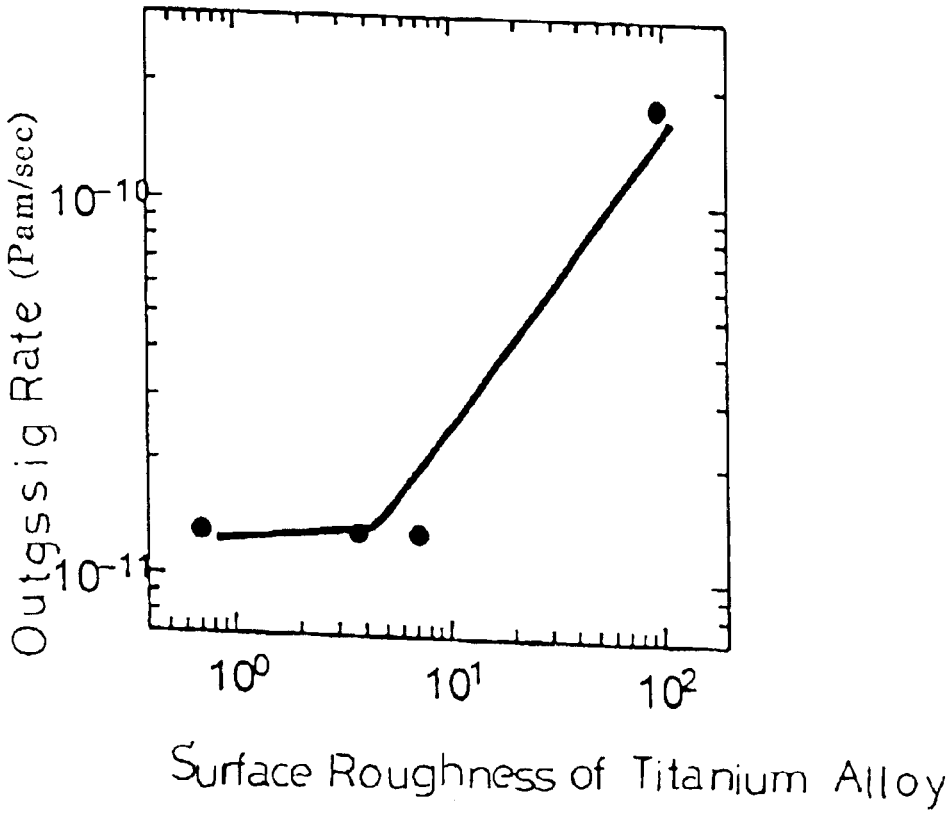
FIG. 1 is a drawing that shows one example of the relationship between the surface roughness and the outgassing rate of a titanium alloy that is preferably used as a material of a titanium alloy vacuum container and vacuum parts of the present invention.

In the present invention, the vacuum container is not intended to be limited by a so-called container shape, and includes means that encloses a space evacuated into a vacuum state, and has a pipe shape or a duct shape.

In general, the evacuation process of a vacuum container exposed to the atmosphere is said to include four processes, that is, (1) process in which the pressure is reduced exponentially depending on the volume, (2) process in which gases adsorbed to the inner surface of the container are separated therefrom so that a pressure is determined, (3) process in which gases, diffused from the inside of the material of the container and evacuated into the vacuum, determine the pressure, and (4) process in which lastly gases permeated from the atmosphere determine the pressure, and in this evacuation process, in order to easily achieve an ultra-high vacuum in a short time, it is particularly essential to shorten the processes (2) and (3). In other words, it is necessary to reduce the quantity of gases to be adsorbed onto the surface, to quickly separate these therefrom, and also to reduce the quantity of outgassing from the inside of the material through diffusion.

In general, the quantity of outgassing from the vacuum material is represented by a outgassing rate (Pa m/sec), and in order to achieve an ultra-high vacuum of approximately $1\times10^{-8}$ Pa, it is necessary to obtain a gas discharging rate of $10^{-9}$ to $10^{-10}$ Pa m/sec, and in order to achieve an extremely-high vacuum of not more than $1\times10^{-9}$ Pa, it is necessary to obtain an outgassing rate of approximately not more than $10^{-10}$ Pa m/sec.

The inventors of the present invention have studied the causes of outgassing from a vacuum material from various aspects so as to reduce the quantity of outgassing from the vacuum container and vacuum parts so as to select the material. In other words, based upon the judgment that required conditions are (1) to use a material having a compact structure and an appropriate hardness so as to easily obtain a surface that is formed into a mirror face for reducing the quantity of adsorbed gas and (2) to use a material having a compact structure which contains only a small quantity of gases inside thereof, and can prevent gas diffusion, in order to reduce the diffusion and desorption of gases from the inside of the material, a titanium alloy, which has a compact structure with fine grains and an appropriate hardness, is easily subjected to a mirror-surface applying process, and has a small quantity of gases contained inside of the material since it is formed through a high-vacuum refining process, is selected as the vacuum material that can satisfy the above-mentioned requirements.

In the next step, upon considering which titanium alloy is the most suitable for the ultra- to extremely-high vacuum material, one attempt is to develop a new titanium alloy; however, as described above, in addition to titanium alloys that have been developed as the vacuum-use material, various titanium alloys have already been developed, and since it is advantageous from the viewpoint of costs to find a desirable titanium alloy as the ultra-high vacuum material from these conventional alloys, the inventors of the present invention have carried out various researches on the conventionally developed titanium alloys with respect to the applicability to the ultra-high vacuum material, and have devised the present invention.

In other words, in addition to the above-mentioned characteristics of the titanium alloy, with respect to the compactness, a compact structure having fine grains of approximately not more than 10 $\mu$m is set as the first condition; with respect to the surface smoothing process, the surface roughness which provides an outgassing rate in a level of $10^{-11}$ Pa m/sec that is sufficiently applicable to an extremely-high vacuum device of not more than $1\times10^{-9}$ Pa is set as the second condition; the operability that allows a comparatively easy surface smoothing process so as to obtain a predetermined surface roughness is set as a preferable condition; and a material hardness that provides preferable processability and endurance is set as a preferable condition; thus, with respect to titanium alloys that have already been developed, tremendous research efforts have been made to find titanium alloys that satisfy the above-mentioned conditions.

To have a compact structure with fine grains in the crystal particle size is one of factors that enable the mirror-face applying process, and makes it possible to reduce diffusion and desorption of gases from the inside of the material, and, as also shown in the above-mentioned Japanese Patent Laid-Open Publication No. H10(1998)-017962, this property also improves the anti-scratching property, and is preferably applicable to a material for the ultra- to extremely-high vacuum device in which leakage from the atmosphere needs to be strictly prevented, and with respect to setting conditions, conditions need to be desirably set so as to provide the device easily at low costs from the industrial point of view; therefore, in the present invention, which will be described later in detail, the crystal grain is set to approximately not more than 10 $\mu$m so as to achieve a titanium alloy having properties that is a preferably used as a vacuum-use material.

The surface roughness for achieving an outgassing rate of $10^{-11}$ Pa m/sec, which will be described in detail in the examples later, is set to not more than 50 nm, as the result of measurements and examinations carried out between the surface roughness and the outgassing rate.

As described above, the titanium alloy vacuum container and vacuum parts of the present invention of the present invention are a vacuum container and vacuum parts whose main parts are made of a titanium alloy, and the titanium alloy has a compact structure with fine grains, each having a grain size of approximately not more than 10 $\mu$m, and a surface that is exposed to at least vacuum is set to have a surface roughness of not more than 50 nm; thus, it becomes possible to greatly reduce the quantity of gases desorpted from the inner surface of the container and the quantity of diffusion and desorption gases from the inside of the container material, and consequently to easily achieve an extremely-high vacuum in a short time through vacuum evacuation.

Moreover, the surface roughness of the titanium alloy is set to not more than 10 nm so that it is possible to reduce the quantity of gases separated from the material surface to a minimum level, that is, to a quantity that is negligible in comparison with the quantity of diffusion gases from the inside of the material or the quantity of gases permeated from the atmosphere, and it becomes possible to carry out the present invention more preferably. Here, titanium alloys, which will be described later, make it possible to achieve a surface roughness of approximately 5 nm even by the use of a comparatively simple polishing method, and consequently to carry out the present invention preferably.

In general, a vacuum flange portion of the ultra-high vacuum device is allowed to have knife edges so that a vacuum sealing process is carried out by sandwiching a metal gasket between these; therefore, it is necessary to prepare a material having an appropriate hardness that is less susceptible to vacuum leakage even after a number of flange opening and closing processes, and free from problems with the processability. As described earlier, titanium having a hardness of 110 to 160 Hv is susceptible to vacuum leakage even after the opening and closing processes of approximately ten times; in contrast, a titanium alloy (Ti-6Al-4V) having a hardness of 350 Hv has difficulty in machining and also has high costs.

Moreover, not limited to the vacuum flange portion, the hardness of a titanium alloy is an important factor, and the inventors of the present invention formed a prototype vacuum container by using Ti-6Al-4V; however, there were problems in which: the tool of the cutting process had abrasion quickly, and difficulty in welding due to a large quantity of alloy elements contained therein caused vacuum leakage from the welded portion. Furthermore, another problem is that a titanium alloy having a large quantity of alloy added thereto is expensive.

After researches have been carried out on the performance after applications of a multiple of times of the vacuum sealing portion with respect to titanium alloys which will be described later, based upon the above-mentioned research achievements, a preferable titanium alloy hardness is set to a range from not less than 230 Hv to not more than 310 Hv since it has been confirmed that this range prevents vacuum leakage from occurring even after the opening and closing processes of not less than 30 times.

Moreover, it has been conventionally known that the formation of an even passivity surface film such as a thin titanium oxide layer or nitride layer on the surface by using a thermal oxidizing process or a nitriding process makes it possible to prevent gases inside the material from dispersing and permeating (for example, Y. Itoh, M. Minato, J. Vac. Soc. Jan., Vol. 40, No. 3, pp.248–250(1997)), and in the present invention also, the titanium alloy may have a thin titanium oxide layer or nitride layer formed on the surface thereof. In this case, the film thickness of the passivity surface film is preferably set to not more than 10 nm so as to effectively provide an extremely-high vacuum while avoiding an increase in the gas adsorption surface. Here, it has been confirmed that the even thin oxide film and nitride film, which form the passivity surface film, can be easily formed by using the titanium alloy which will be discussed later in detail by reference to examples.

The titanium alloy, which is preferably used as the above-mentioned vacuum container and vacuum parts, is titanium alloy KS100 that has been disclosed in the above-mentioned Japanese Patent Laid-Open Publication No. H10(1998)-017962, and, after detailed researches have been carried out with respect to the applicability to the vacuum device, it is also found that a titanium alloy, which contains 0.3 wt. % to 0.5 wt. % of iron and 0.3 wt. % to 0.5 wt. % of oxygen, with the remainder being made from titanium Ti and obligatory impurities, and is disclosed in Japanese Patent Laid-Open Publication No. H10(1998)-017962 as its best mode for carrying out the invention, is also applicable.

The detailed example including the manufacturing method of this titanium alloy has been disclosed in Japanese Patent Laid-Open Publication No. H10(1998)-017962, and in the present invention, the reason for the limitation inserted in the range of the chemical component composition of the titanium alloy is explained as follows: the oxygen content of less than 0.3 wt. % causes insufficient hardness, the oxygen content exceeding 0.5 wt. % causes degradation in the processability (moldability), the iron content of less than 0.3 wt. % causes degradation in the surface roughness, and the iron content exceeding 0.5 wt. % causes degradation in the processability (weldability).

"EXAMPLES"

The following description will discuss examples of the present invention in detail.

First, the first example will discuss the results of experimental researches carried out on the relationship between the surface roughness and the outgassig rate.

A sample used in this case contains the above-mentioned titanium alloy KS100 (which contains oxygen 0.35 wt. % and iron 0.35 wt. %, with the remainder being made from titanium Ti and obligatory impurities), and sample TN that was not polished, samples TP1 to TP3 that had been polished and stainless sample SP that had been polished so as to be used for comparative purposes were prepared, and experiments were carried out on the outgassing rate by using an orifice method. Here, with respect to each of the samples, 180 sheets, each having a size of 20 mm×20 mm×1 mmt, were utilized. Moreover, these measurements on the outgassing rate using the orifice method were carried out by using a prototype titanium alloy vacuum container, which will be described as the second embodiment.

With respect to the preliminary process for the samples, after having been washed with alcohol, these samples were only subjected to a heating process of 90° C.×24 h in the atmosphere. With respect to the measuring conditions, 30 minutes after the device had been opened to the atmosphere, its evacuation system was activated to carry out an evacuation process for 3 hours, and a vacuum baking process was then carried out for 48 hours with the chamber being set to 180° C. and the sample unit being set to 220° C.; thus, the outgassing rate was found based upon the achieved pressure after a cooling process of 48 hours. Here, this baking temperature was set to a comparatively low temperature on the assumption of the actual use of the vacuum device.

Table 1 and FIG. 1 show the resulting relationship between the surface roughness and the outgassing rate.

The surface roughness refers to center line average roughness (Ra) measured by an atomic force microscope (AFM)in a range of 10×10 $\mu$m. Here, the outgassing rate value, $1.3\times10^{-11}$ Pa m/sec, shown as the result of the measurements of samples TP1 to TP3, indicates virtually the same value as the detection limit under the present measuring device and measuring conditions.

TABLE 1

| | TN | TP1 | TP2 | TP3 | SP |
|---|---|---|---|---|---|
| Surface roughness Ra (nm) | 5.1 | 7.1 | 3.8 | 0.7 | 2.4 |
| Outgassing rate (Pam/sec) | $1.8\times10^{-10}$ | $1.3\times10^{-11}$ | $1.3\times10^{-11}$ | $1.3\times10^{-11}$ | $1.4\times10^{-10}$ |
| Remark | Examples of the Present Invention | | | | Comparative example |

The surface roughness of the titanium alloy TN that has not been polished is about 50 times as rough as the stainless steel SP that has been subjected to polishing; however, its outgassing rate is $1.8\times10^{-10}$ Pa m/sec, which is the same level as that of the stainless steel. This is because the titanium alloy has been subjected to a vacuum dissolving process in its manufacturing process, and because the crystal grains of the titanium alloy are formed into fine grains to have a compact structure.

FIG. 1 shows that in order to achieve an outgassing rate (not more than $1\times10^{-10}$ Pa m/sec) required for an extremely-high vacuum, the surface roughness is preferably set to not more than 50 nm.

Here, the fact that the outgassing rate is reduced linearly together with the surface roughness in a range of 10 to 100 nm in the surface roughness indicates that the gases desorpted from the surface form a controlling quantity of outgassing, and the fact that the outgassing rate has a saturating trend at the surface roughness in a range of not more than 10 nm indicates that the gases derived from other causes, such as dispersed and desorpted gases from the inside of the material form a controlling quantity of gas desorption. In general, the outgassing characteristic has the above-mentioned trend so that the surface roughness is preferably set to a point having the saturating trend.

As described above, in the present experiments, since the measured values of TP1 to TP3 in the case of the surface roughness of not more than 7.1 nm are virtually the same as the measuring resolution, the surface roughness that exhibits the saturating trend might be further smaller than approximately 10 nm; however, even in this case, the surface roughness of 10 nm, which can achieve not more than 1/10 of the outgassing rate ($1\times10^{-10}$ Pa m/sec) that is required for an extremely-high vacuum, normally makes it possible to form a sufficient setting condition.

Next, in the second example, the following description will discuss the results of experiments that were carried out on the gas diffusion and discharge characteristics, which raise problems in a super-high vacuum area.

After the measurements on the gas discharging rate in the first example, these experiments were carried out by measuring the temperature dependence of the gas discharging rate using titanium alloy sample TP1 having a roughness of 7. 1 nm, and Table 2 shows the results of the experiments.

TABLE 2

| | | | | |
|---|---|---|---|---|
| Inverse of temperature 1000/T(1/K) | 2.27 | 2.89 | 3.04 | 3.19 |
| Outgassing rate (Pam/sec) | $8.2\times10^{-11}$ | $7.2\times10^{-11}$ | $5.1\times10^{-11}$ | $3.1\times10^{-10}$ |

The results of Table 2 were indicated by using Arrhenius plotting process to find the activation energy in the gas discharging, and the resulting value was given as approximately 20 kJ/mol, and this value was much smaller than the activation energy, that is, approximately 45 kJ/mol, for hydrogen diffusion in stainless steel. In other words, together with the very small outgassing rate of $1.3\times10^{-11}$ Pa m/sec at room temperature shown in the first example, the present example has confirmed that the present titanium alloy makes it possible to provide a small activation energy for the outgassing; therefore, it has been proved that the quantity of outgassing due to diffusion gasses is smaller than that of the conventional stainless steel.

Additionally, in the present experiments, measurements were started after the device had been subjected to a vacuum baking process for 48 hours, and then cooled off naturally for 48 hours; therefore, the activation energy for outgassing thus found was considered to be activation energy due to the gas diffusion.

Next, in the third example, the following description will discuss a prototype titanium alloy vacuum container.

Figure 2:
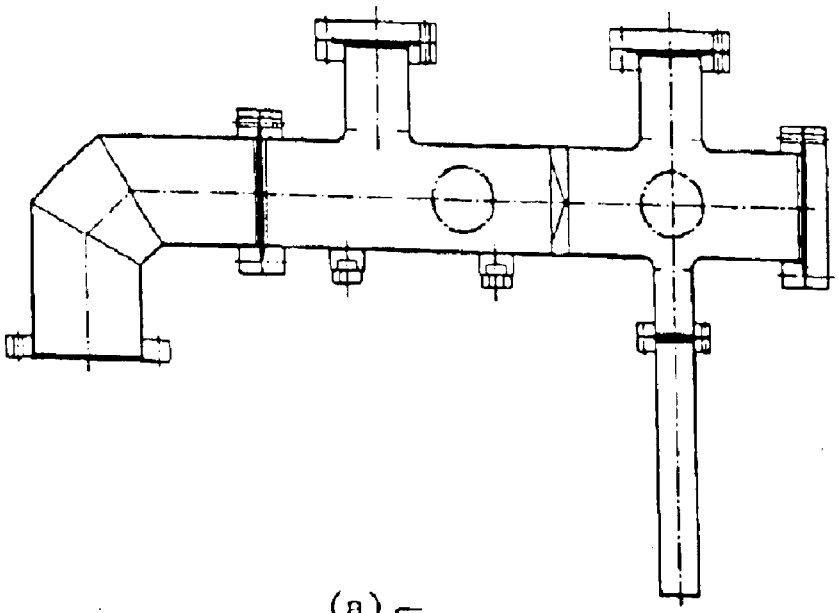
FIG. 2 is an outside drawing of a prototype vacuum container that is an example of the titanium alloy vacuum container of the present invention, and includes two face views, that is, (a) front view and (b) top view.
Figure 2:
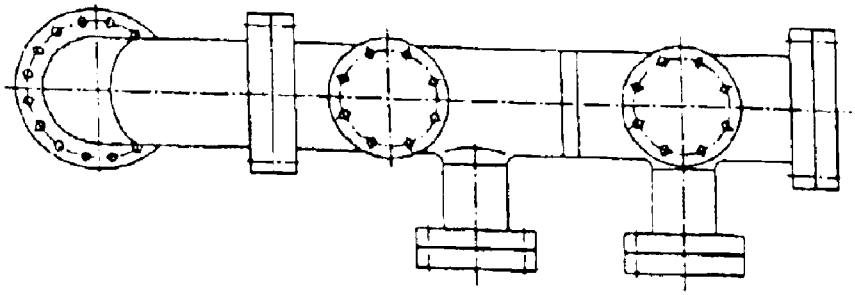

FIG. 2 is an outside drawing of a prototype vacuum container that is an example of the titanium alloy vacuum container of the present invention, and includes two face views, that is, (a) front view and (b) top view.

A titanium alloy used in this example was KS100 having a surface roughness of 3.8 nm that had been surface-polished, and a vacuum container had a capacity of $6.7\times10^{-3}$ $m^3$ and an inner surface area of $375\times10^{-3}$ $m^2$, and is partitioned in the middle portion thereof by an orifice with a small hole having a diameter of 5.4 mm ϕ formed therein so that it is divided into a downstream vacuum chamber (a capacity of $4.2\times10^{-3}$ $m^3$ and an inner surface area of $210\times10^{-3}$ $m^2$)and an upstream vacuum chamber (a capacity of $2.5\times10^{-3}$ $m^3$ and an inner surface area of $165\times10^{-3}$ $m^2$). Here, although not shown in the Figures, an evacuation device in which turbo molecular pumps (TMP) having $550\times10^{-3}$ $m^3$/sec and $150\times10^{-3}$ $m^3$/sec are series-connected to a main evacuation pump with an oil-sealed rotary pump (RP) of $150\times10^{-3}$ $m^3$/min being used as a coarse suction pump is connected to the downstream vacuum chamber, and nude-type ionization vacuum gauges (EG) are attached to the downstream vacuum chamber and the upstream vacuum chamber.

The following description will discuss evacuation experiments of the present titanium alloy vacuum container.

Normally, the heating temperature for vacuum baking of the vacuum container is set to not less than 200° C.; however, in this case, with the temperature being set to a comparatively low temperature of 160° C., a vacuum baking process was carried out for 48 hours, and the pressure of the vacuum container was then measured for 48 hours.

Figure 3:
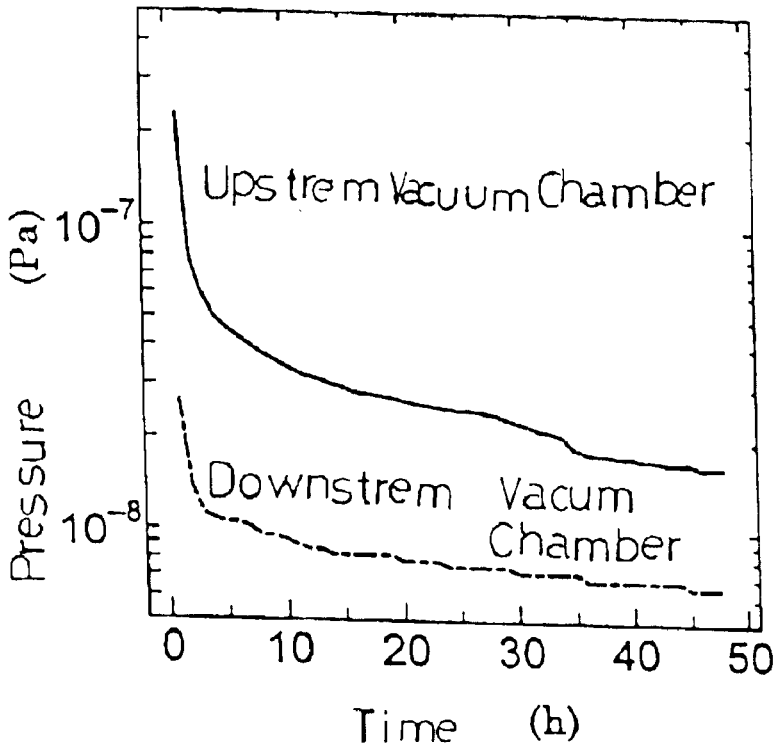
FIG. 3 is a drawing which shows an evacuation characteristic of the prototype vacuum container of FIG. 2, and is a pressure-evacuation curve that shows one example of a case in which evacuation is carried out after a vacuum baking process.

FIG. 3 shows pressure-evacuation curves of the upstream vacuum chamber (indicated by a solid line) and the downstream vacuum chamber (indicated by an alternate long and short dash line), with the completion time of the vacuum baking being set to 0, and in the case of the present evacuation experiments, the upstream vacuum chamber and the downstream vacuum chamber were allowed to reach an ultra-high vacuum range, that is, $8.0\times10^{-8}$ Pa and $1.4\times10^{-8}$ Pa, respectively, in a comparatively short evacuation time of 2 hours, and 48 hours later, the upstream vacuum chamber and the downstream vacuum chamber were allowed to reach an extremely-high vacuum range, that is, $1.6\times10^{-8}$ Pa and $6.5\times10^{-9}$ Pa, respectively, although the vacuum baking process was carried out at a comparatively low temperature. Here, the reason that the upstream vacuum chamber had a pressure higher than that of the downstream vacuum chamber was because the orifice placed in the middle portion of the vacuum chamber made the evacuation rate ($2.6\times10^{-3}$ $m^3$/sec) in the upstream vacuum chamber smaller than the evacuation rate of the downstream vacuum chamber by approximately two digits.

The following description will discuss the results of evacuation experiments without vacuum baking, which were carried out so as to prove superior vacuum performances of the titanium alloy vacuum container of the present invention.

Figure 4:
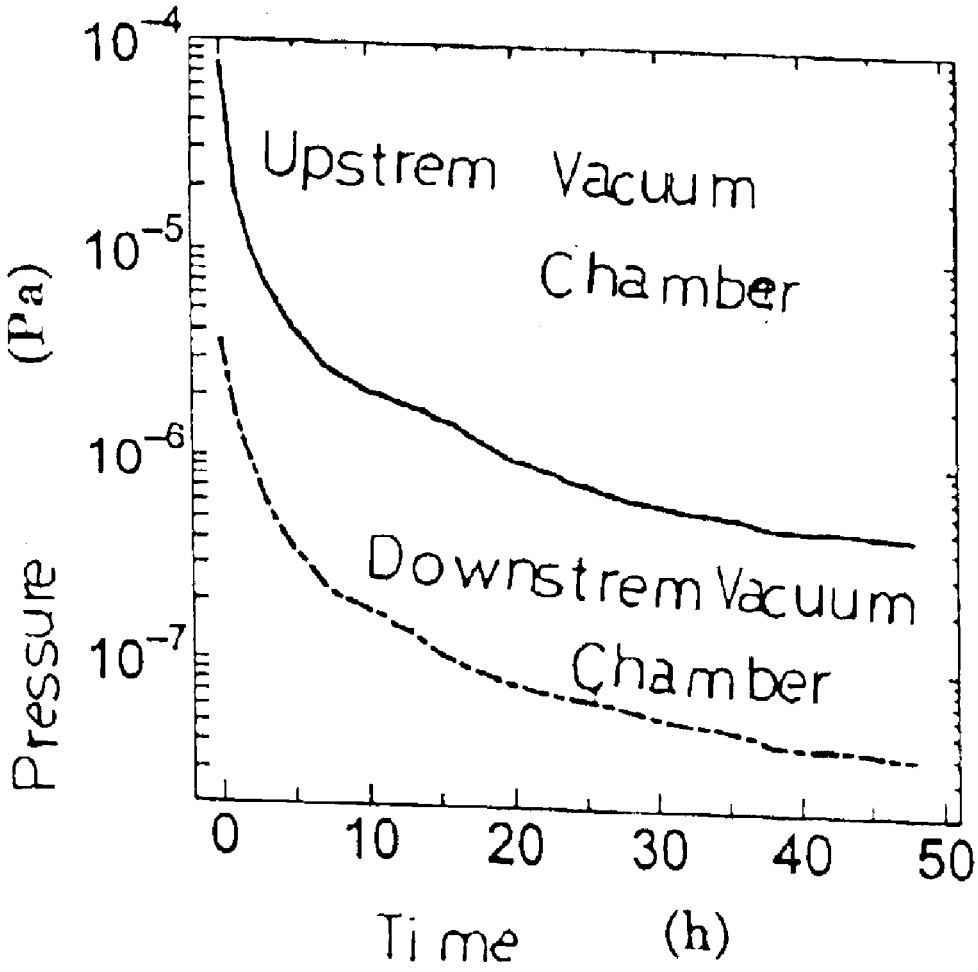
FIG. 4 is a drawing that shows an evacuation characteristic of the prototype vacuum container of FIG. 2, and is a pressure-evacuation curve that shows one example of a case in which no vacuum baking process is carried out.

FIG. 4, which gives the results of the experiments, shows a pressure-evacuation curve without vacuum baking obtained based upon the start time of TMP that is a main evacuation pump.

As shown in FIG. 4, the pressure of a downstream vacuum chamber (indicated by an alternate long and short dash line) of a normal vacuum device (with a structure in which evacuation is directly carried out by the vacuum evacuation device without using an orifice or the like) was allowed to reach $6.2\times10^{-7}$ Pa 3 hours later, $5.7\times10^{-8}$ Pa 30 hours later, and $3.9\times10^{-8}$ Pa 48 hours later. In other words, without the necessity of vacuum baking, the titanium alloy vacuum container of the present invention makes it possible to achieve an ultra-high vacuum range in the order of $10^{-7}$ Pa through an evacuation process in a short time, and also to achieve a pressure in the order of $10^{-8}$ Pa easily.

In contrast, the pressure of an upstream vacuum chamber (indicated by a solid line) was allowed to reach $7.0\times10^{-6}$ Pa 3 hours later, $6.3\times10^{-7}$ Pa 30 hours later, and $4.6\times10^{-7}$ Pa 48 hours later, and these values were higher than those of the downstream vacuum chamber by virtually one digit; and this is because, as described above, the evacuation rate for the upstream vacuum chamber is greatly reduced by the resistance of the orifice.

As described above, the first example and the second example have actually proved that by using titanium alloy KS100 (which contains oxygen 0.35 wt. % and iron 0.35 wt. %, with the remainder being made from titanium Ti and obligatory impurities) which has a compact structure with fine grains of not more than 10 μm and making the surface roughness smaller, it becomes possible to reduce the outgassing rate, that in order to achieve an outgassing rate (not more than $1\times10^{-10}$ Pa m/sec) required for achieving an extremely-high vacuum, the surface roughness is preferably set to not more than 50 nm, and that it is more preferable to set the surface roughness to not more than 10 nm. It is also proved that the quantity of outgassing from the inside of the material due to diffusion and desorption becomes smaller than the conventional stainless steel.

In the third example, a prototype titanium vacuum container using such titanium alloy KS100 was formed, and through the evacuation experiments carried out on this container, it has been proved that even the application of a comparatively simple vacuum evacuation device makes it possible to achieve an ultra-high vacuum in a short time through evacuation, and that it is possible to easily achieve an ultra-high vacuum of $10^{-8}$ Pa without the necessity of baking.

In the fourth example, the following description will discuss the results of endurance tests of a titanium alloy vacuum flange having a knife edge structure.

The sample was a vacuum flange made of the above-mentioned titanium alloy KS100 (hardness 280 Hv), and two kinds of the samples having diameters of ϕ69. 3 mm (ICF70) and 113.5 mm (ICF114) were prepared, and two kinds of flanges made of pure titanium (JIS-Type 2: Hardness 145 Hv) were prepared as comparative flanges.

The experiments were carried out by sandwiching an oxygen free copper gasket that was a general ultra-high vacuum-use sealing member with two sample flanges and examining the vacuum leakage from the vacuum sealing portion by using a vacuum leak tester (helium leak detector). The number of tests was set to 30 times.

Table 3 shows the results of the tests, and in this case, with respect to the presence or absence of vacuum leakage, a pressure of not less than $1\times10^{-1}$ ° Pa $m^3$/sec was determined as leakage of vacuum, and the consumption of the knife edge was determined through visual examination.

TABLE 3

| | Titanium alloy (280 Hv) (Examples of the present invention) | | Pure titanium JIS-type 2 (145 Hv) (Comparative examples) | |
|---|---|---|---|---|
| | ICF70 | ICF114 | ICF70 | ICF114 |
| Presence or absence of leakage | Absent | Absent | Absent | Present |
| Number of occurrences of leakage | — | — | — | 21 times |
| Consumption of edge | Absent | Absent | Slightly present | Present |

As described earlier, it has been known that pure titanium causes vacuum leakage due to repetitive applications, and in the present experiments also, in the case of ICF114, vacuum leakage occurred in the $21^{st}$ process, and in the case of ICF70 that caused no leakage, there was abrasion in the flange knife edge portion that was a contact face to the oxygen free copper basket. In contrast, in the case of the titanium alloy flange of the example of the present invention, neither vacuum leakage nor abrasion in the flange knife edge occurred.

In the fifth example, the following description will discuss an example in which a thin titanium oxide layer is formed on the surface of a titanium alloy.

The above-mentioned titanium alloy KS100 in which the surface roughness was set to 0.7 nm was used as a sample. The reason that the surface roughness was set to 0.7 nm was because it was considered that separations or cracks in the microscopic structure due to oxidation would be observed by an atomic force microscope. The separations and cracks in the structure cause an increase in the outgassing rate, and the passivity surface film, which reduces the outgassing rate, needs to be prepared as an even surface film that is free from separations and cracks in the structure in its microscopic area.

The titanium alloy was oxidized through a thermal oxidation. In other words, the titanium alloy was put into a vacuum chamber, and a vacuum was drawn to a pressure of $4\times10^{-4}$ Pa, and after the sample had been subjected to a baking process for 2 hours at a temperature higher than the oxidizing process temperature by 20° C., the sample temperature was then set to the oxidizing process temperature, and oxygen (purity: 99.7 %) of 1 atmospheric pressure was introduced therein so that an oxidizing process was carried out for two hours. Four kinds of the oxidizing process temperatures, 150, 200, 300, 400° C., were set.

As the results of visual examinations, virtually no discoloration was found in the titanium alloy of the process temperature of 150° C.; however, as the process temperature rose, the sample of 200° C. was discolored to a thin golden color, the sample of 300° C. was discolored to a golden color, and the sample of 400° C. was discolored to a bluish purple color. This indicates that the titanium oxide was formed at process temperatures of not less than 200° C.

Next, with respect to the samples that had been subjected to an oxidizing process at not less than 200° C., tape separation tests and surface observation by the use of an atomic force microscope were carried out. In this case, with respect to the film thickness of the titanium alloy oxide film, one portion of the oxide film was physically-etched by using an ion beam sputtering method, and measured by a tracer-type surface roughness-measuring meter. Table 4 shows the results of the separation tests and the results of the surface roughness and film-thickness measurements.

TABLE 4

| | Untreated sample | Sample treated at 200° C. | Sample treated at 300° C. | Sample treated at 400° C. |
|---|---|---|---|---|
| Tape separation test | — | Separation absent | Separation absent | Separation present |
| Surface roughness Ra (nm) | 0.72 | 0.76 | 1.9 | — |
| Film thickness (nm) | — | 8 nm | 10 nm | — |

The results of the tape separation tests show that the oxidizing process temperature of 400° C. caused tape separation, and was not suitable for the formation of a passivity surface film.

As the results of observation carried out on the respective surfaces of the untreated sample, the sample treated at 200° C. and the sample treated at 300° C. by the use of an atomic force microscope in a range of 10×10 μm, no microscopic separation roughness was found on the surface of the sample treated at 200° C. in the same manner as the surface of the untreated sample. Moreover, as shown in Table 4, with respect to the surface roughness of the sample treated at 200° C., a value that was virtually the same as that of the untreated sample was obtained. In other words, the oxidizing process at 200° C. provides a preferable condition for forming an extremely even oxide film. Here, the film thickness of the titanium oxide layer of the sample treated at 200° C. was approximately 8 nm.

In contrast, with respect to the surface of the sample treated at 300° C., separation and roughness having a size of approximately 1×1 μm were observed, and these made the surface roughness (1.9 nm) three times as rough as that of the untreated sample. Moreover, the film thickness of the oxide film of this sample was approximately 10 nm. In other words, it has been found that, in comparison with the oxidizing process at 200° C., the oxidizing process at 300° C. did not allow the oxidation to progress in the depth direction of the titanium alloy while the oxidation on the surface layer progressed, with the result that the rough surface was simply formed.

Based upon the above-mentioned facts, the surface oxidizing process conditions of the titanium alloy used in the present examples are preferably set at 200° C. in the oxidizing process temperature, with approximately 2 hours in the oxidizing process time, and it has been clarified that this oxidizing process makes it possible to form an extremely even thin oxide film having a thickness of approximately 8 nm in cooperation with the effect that the original roughness is set to a small level of 0.7 nm. As has been conventionally known, this titanium oxide film forms a passivity surface film that is used for reducing the outgassing rate, and this technique forms one of important element-forming techniques that provide an effective extremely-high vacuum device.

Here, in the case when an oxide film is formed on a rough surface (for example, film thickness 20 to 50 nm) of a metal material, it becomes difficult to evaluate separations, cracks, etc. in the microscopic structure that cause an increase in the outgassing rate; however, in the present examples, the surface roughness is set to 0.7 nm so as to allow observation by the use of an atomic force microscope so that it becomes possible to evaluate the surface state of the oxide film in a microscopic manner; thus, it becomes possible to determine optimal oxide film forming conditions.

The above description has explained a preferable oxidizing process of a titanium alloy; however, it is possible to form a passivity surface film by using a titanium nitride film formed through a surface nitriding process of a titanium alloy, in the same manner.

Next, in the sixth example, the following description will discuss the results of evaluation with respect to the processability, etc. of titanium alloy KS100 that is a desirable titanium alloy to be used in the present invention.

The evaluation processes were carried out in the following manner: plates (2 mmt) of titanium alloys having component compositions shown in Table 5 were manufactured, and subjected to a surface polishing process, and the surface roughness and hardness thereof were measured. Next, the plates of the respective compositions were molded so as to be bent through cold processes, and further joined through TIG welding to form welded pipes having 100 mm in diameter×300 mm in length, and these were compared with each other in processability. The results of the respective evaluation processes are shown in Table 5 in a combined manner.

TABLE 5

| | Component composition (Mass %) | | Material | | | |
|---|---|---|---|---|---|---|
| | | | Surface roughness | Hardness | Processability Cold molding, | |
| No. | o | Fe | Ra ≦ 10 nm | 310 ≧ Hv ≧ 230 | Weldability | Remark |
| 1 | 0.20 | 0.35 | o | 190 | o | Comparative examples |
| 2 | 0.35 | 0.65 | o | 240 | x (Defective welding) | |
| 3 | 0.45 | 0.20 | x | 280 | o | |
| 4 | 0.60 | 0.35 | o | 330 | x (Cold molding in operable) | |
| 5 | 0.30 | 0.30 | o | 230 | o | Examples of the present invention |
| 6 | 0.35 | 0.35 | o | 260 | o | |
| 7 | 0.40 | 0.40 | o | 280 | o | |
| 8 | 0.45 | 0.45 | o | 300 | o | |
| 9 | 0.50 | 0.50 | o | 310 | o | |

Example No. 1 shows a comparative example in which the oxygen content is too small to cause insufficient hardness; example No. 2 shows a comparative example in which the iron content is too much to cause fine cracks in welded portions; example No. 3 shows a comparative example in which the iron content is too small to fail to achieve a surface roughness of not more than 10 nm through a polishing process; and example No. 4 shows a comparative example in which the oxygen content is too much to make a cold molding process inoperable.

In contrast, examples No. 5 to No. 9 are examples which satisfy compositions that are specified as desirable component compositions of titanium alloys in the present invention, and the surface roughness and hardness thereof are set in appropriate ranges, without causing any problems in the processability.

As described above, the titanium alloys in the sixth example have desirable characteristics as materials for a titanium alloy vacuum container and vacuum parts that are the targets of the present invention, and as shown in Japanese Patent Laid-Open Publication No. H10(1998)-017962, these alloys are superior in toughness, organism compatibility and cost performance, and desirably applied as materials for a titanium alloy vacuum container and vacuum parts of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

For example, the third example has explained a prototype titanium alloy vacuum container; however, the present invention is not intended to be limited by the shape or the structure thereof.

Moreover, the fifth example has explained a method for forming a thin titanium oxide layer on the surface of a titanium alloy; however, any method may be used as long as it forms a passivity surface film, and the present invention is not intended to be limited by factors such as the oxidizing process temperature, the oxidizing process time or the titanium oxide film thickness to be formed.

INDUSTRIAL APPLICABILITY

The titanium alloy vacuum container and vacuum parts of the present invention, which relates to a titanium alloy vacuum container and vacuum parts that can greatly reduce the quantity of gases separated from the inner surface of the container and the quantity of diffusion and desorption gases from the inside of the container material, have the effect of easily achieving an ultra-high vacuum in a short time through vacuum evacuation. Moreover, the present invention has advantages in that it is possible to reduce the volume flow rate of the vacuum pump and also to eliminate the necessity of a plurality of evacuation pumps even in an ultra-high to extremely-high vacuum, and consequently has the effect of achieving a vacuum device of an energy-saving type. Such a titanium alloy vacuum container and vacuum parts of the present invention are effectively applied as vacuum containers and vacuum parts to be used for vacuum devices for manufacturing semiconductor thin-films and electronic parts, which require a high throughput, for surface analyzing devices and atom operating devices in which an ultra-high to extremely-high vacuum needs to be achieved, or for high-energy accelerator facilities.

What is claimed is:

1. A titanium alloy vacuum container and vacuum parts, wherein:

main portions thereof are made of a titanium alloy, the titanium alloy has a compact structure composed of fine grains, each having a size of approximately not more than 10 $\mu$m, with a surface that is exposed to at least vacuum being set to have a surface roughness of not more than 50 nm.

2. The titanium alloy vacuum container and vacuum parts according to claim 1, wherein the surface roughness of said titanium alloy is set to not more than 10 nm.

3. The titanium alloy vacuum container and vacuum parts according to claim 1, wherein said titanium alloy has a hardness in a range of not less than 230 Hv to not more than 310 Hv.

4. The titanium alloy vacuum container and vacuum parts according to claim 1, wherein said titanium alloy has a passivity surface film made by a thin titanium oxide layer or nitride layer that is formed on at least the surface exposed to vacuum.

5. The titanium alloy vacuum container and vacuum parts according to claim 4, wherein said passivity surface film has a film thickness of not more than 10 nm.

6. The titanium alloy vacuum container and vacuum parts according to claim 1, wherein said titanium alloy contains 0.3 wt % to 0.5 wt % of iron (Fe) and 0.5 wt % of oxygen (O), and the remainder thereof is made from titanium (Ti) and obligatory impurities.

7. The titanium alloy vacuum container and vacuum parts according to claim 2, wherein said titanium alloy has a hardness in a range of not less than 230 Hv to not more than 310 Hv.

8. The titanium alloy vacuum container and vacuum parts according to claim 2, wherein said titanium alloy has a passivity surface films made by a thin titanium oxide layer or nitride layer that is formed on at least the surface exposed to vacuum.

9. The titanium alloy vacuum container and vacuum parts according to claim 3, wherein said titanium alloy has a passivity surface film made by a thin titanium oxide layer or nitride layer that is formed on at least the surface exposed to vacuum.

10. The titanium alloy vacuum container and vacuum parts according to claim 2, wherein said titanium alloy contains 0.3 wt % to 0.5 wt % of iron (Fe) and 0.5 wt % of oxygen (O), and the remainder thereof is made from titanium (Ti) and obligatory impurities.

11. The titanium alloy vacuum container and vacuum parts according to claim 3, wherein: said titanium alloy contains 0.3 wt % to 0.5 wt % of iron (Fe) and 0.5 wt % of oxygen (O), and the remainder thereof is made from titanium (Ti) and obligatory impurities.

12. The titanium alloy vacuum container and vacuum parts according to claim 4, wherein; said titanium alloy contains 0.3 wt % to 0.5 wt % of iron (Fe) and 0.5 wt % of oxygen (O), and the remainder thereof is made from titanium (Ti) and obligatory impurities.

13. The titanium alloy vacuum container and vacuum parts according to claim 5, wherein: said titanium alloy contains 0.3 wt % to 0.5 wt % of iron (Fe) and 0.5 wt % of oxygen (O), and the remainder thereof is made from titanium (Ti) and obligatory impurities.

* * * * *